US008573457B1

(12) United States Patent
Morgan

(10) Patent No.: US 8,573,457 B1
(45) Date of Patent: Nov. 5, 2013

(54) GOLFER'S ORGANIZER

(76) Inventor: Samuel F. Morgan, Rancho Dominguez, CA (US)

( * ) Notice: Subject to any disclaimer, the term of this patent is extended or adjusted under 35 U.S.C. 154(b) by 0 days.

(21) Appl. No.: 13/447,558

(22) Filed: Apr. 16, 2012

Related U.S. Application Data

(63) Continuation-in-part of application No. 11/192,696, filed on Jul. 29, 2005, now abandoned.

(60) Provisional application No. 60/592,936, filed on Jul. 30, 2004.

(51) Int. Cl.
*A45F 5/00* (2006.01)

(52) U.S. Cl.
USPC ..... 224/673; 224/680; 224/251; 224/918; 224/919

(58) Field of Classification Search
USPC ..... 224/918, 932, 587, 673, 681, 680, 251, 224/919; 206/315.9; 150/147; 473/406, 473/408; D3/224
See application file for complete search history.

(56) References Cited

U.S. PATENT DOCUMENTS

| | | | | | |
|---|---|---|---|---|---|
| D314,222 | S | * | 1/1991 | Viguers et al. | D3/224 |
| D318,625 | S | * | 7/1991 | Stowell | D10/31 |
| 5,183,154 | A | * | 2/1993 | Slemp | 206/315.9 |
| 5,799,853 | A | * | 9/1998 | Brewster | 224/679 |
| 5,848,742 | A | * | 12/1998 | Wang | 224/274 |
| 5,934,530 | A | * | 8/1999 | Antczak et al. | 224/197 |
| 6,095,934 | A | * | 8/2000 | Ohama | 473/408 |
| 6,148,443 | A | * | 11/2000 | Maastricht | 2/69 |
| 6,202,911 | B1 | * | 3/2001 | Freer | 224/684 |
| 6,209,766 | B1 | * | 4/2001 | Kwon | 224/269 |
| 6,220,973 | B1 | * | 4/2001 | Hsu | 473/408 |
| 6,357,586 | B2 | * | 3/2002 | Pratt et al. | 206/315.9 |
| 6,481,595 | B1 | * | 11/2002 | Chilton | 221/185 |
| 6,769,587 | B1 | * | 8/2004 | Lomas | 224/663 |
| 2004/0016787 | A1 | * | 1/2004 | Ioime | 224/669 |
| 2006/0169731 | A1 | * | 8/2006 | Matulewic | 224/674 |

* cited by examiner

*Primary Examiner* — Justin Larson
(74) *Attorney, Agent, or Firm* — Kenneth L. Tolar

(57) ABSTRACT

A device for storing golfing accessories includes a semi-rigid, planar housing having a passageway formed therein for suspending the housing from a golfer's belt. Cleaning cloths, golf tee holders, a pencil holder, a timepiece, a divot-repair tool and a stroke counter are positioned on the front surface of the housing. The top end of the housing is adapted to slidably receive a scorecard while the lower end includes a golf ball storage receptacle.

18 Claims, 2 Drawing Sheets

GOLFER'S ORGANIZER

CROSS REFERENCE TO RELATED APPLICATIONS

This application is a continuation-in-part of application Ser. No. 11/192,696 filed on Jul. 29, 2005, now abandoned, which claimed the benefit of provisional application No. 60/592,936 filed on Jul. 30, 2004, the specifications of which are hereby incorporated by reference.

BACKGROUND OF THE INVENTION

The present invention relates to a belt attachment for conveniently storing a plurality of golfing accessories, such as tees, balls, scorecards and other items.

DESCRIPTION OF THE PRIOR ART

In addition to golf clubs, golfers use numerous accessory items, such as tees, balls, divot-repair tools, cleaning cloths and similar items. Typically, many of these items must be stored in the golfer's pants pocket, which is uncomfortable. Otherwise, the items are stored in a golf cart or golf bag requiring the golfer to repeatedly travel to and from a remote location, which is time consuming and inconvenient.

Furthermore, many golf courses require players to complete a round within a prescribed time period and many tournament officials will fine or penalize slow players. Accordingly, a golfer must be able to monitor time while playing a round of golf. However, wearing a wristwatch is distracting and hinders the golfer's swing.

Various golfers' organizers exist in the prior art that are purported to address some of the above-described problems. For example, U.S. published patent application no. 2004/0016787 filed on behalf of Ioime discloses a golfing accessory that is securable to a belt, pocket or other object. The device includes a ball retainer and a ball marker holder.

U.S. Pat. No. 5,934,530 issued to Antezak discloses a golf accessory organizer including a main supporting member having tee holders and a ball marker secured thereto. Golf balls can be stored either within a pouch depending from the supporting member, or a hinged pressure clip; the supporting member may also include a hook-and-loop fastener for securing items such as a divot tool, a golf glove or sunglasses.

U.S. Pat. No. 6,202,911 issued to Freer discloses a belt-mounted golf accessory organizer including various pockets for receiving golf balls, tees, score pencils, divot-repair tools and similar items. The device also includes a hook-and-loop panel for attaching a golf glove, a golf towel or a club-face cleaning tool.

U.S. Pat. No. 6,209,766 issued to Kwon discloses a belt-mounted apparatus for carrying golf accessories including a belt saddle clip having a plurality of tee holders and ball marker holders on an outer surface thereof. The saddle clip also includes a cavity with a watch hingedly received therein.

U.S. Pat. No. 6,769,587 issued to Lomas discloses a belt-mounted golf accessory holder including a container having a hinged flap that selectively closes an open top. Within the container interior is a storage compartment for receiving golf balls and similar items.

Although various golfers' organizers exist in the prior art, none include all of the features and advantages of the present invention, particularly, an abacus-type stroke counter, a dangling timepiece that is viewable by the wearer and others, various cleaning tools and a scorecard holder. Though Kwon discloses a timepiece, it must be unfurled from a cavity, which is burdensome, and does not allow those nearby other than the wearer to determine the time. Furthermore, because the timepiece is hingedly connected to a saddle clip, it cannot be readily detached when the apparatus is cleaned. Additionally, each of the above-described devices are bulky, irregularly-shaped and asymmetrical so as to significantly hinder a wearer's swing.

SUMMARY OF THE INVENTION

The present invention relates to a golfer's organizer for storing a plurality of golfing accessories. The device comprises a substantially-planar, rigid housing having a front surface, a rear surface, a pair of side edges, a top end and a bottom end. On the lower end of the housing is a barrel-shaped golf ball holder for storing a plurality of golf balls. On the front surface of the housing, immediately above the golf ball holder, is a nylon cleaning strip for removing debris from various accessories. Immediately above the strip is a terry-cloth, which can be used to apply moisture to heavily-stained golf balls. Adjacent the terrycloth are a tubular pencil holder and a plurality of golf tee retaining sleeves. An abacus-type stroke counter is disposed above the tee holders for assisting a golfer with monitoring strokes. The upper end of the housing includes a narrow slit in communication with an interior compartment for slidably receiving a scorecard. A belt passageway extends from one side edge of the housing to the other for suspending the housing from a golfer's hip. On one of the side edges is a compartment that removably receives a helical cord having a drying cloth and a club-face groove cleaning tool secured thereto. On the rear surface of the housing are a pair of zippered pouches for receiving business cards, keys and similar items.

It is therefore an object of the present invention to provide an organizer that allows a golfer to conveniently access a myriad of golfing accessories.

It is another object of the present invention to provide a golfer's organizer that can be quickly and conveniently attached to a golfer's belt.

It is yet another object of the present invention to provide a golfer's organizer that is compact and symmetrical so as not to inhibit a golfer's swing.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
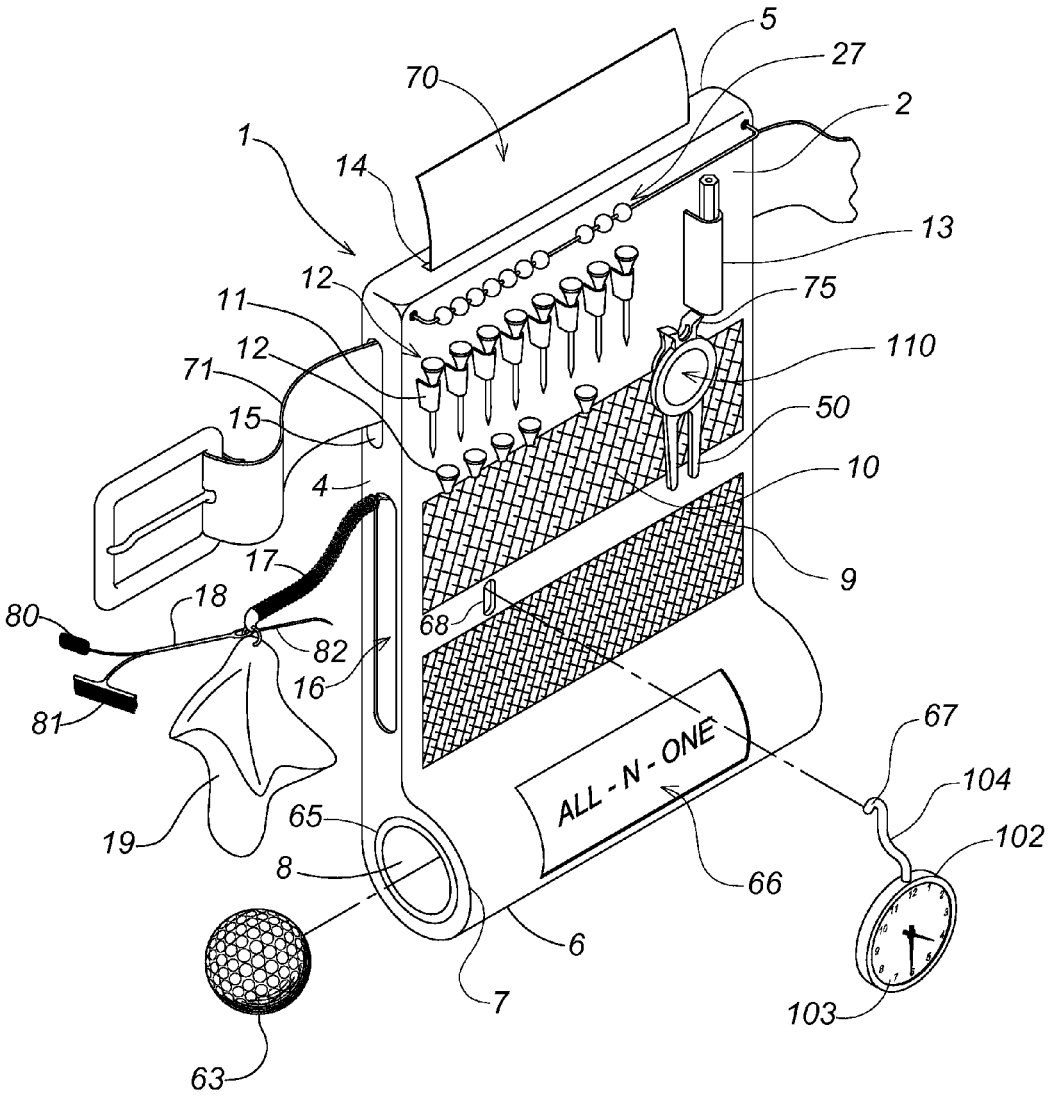
FIG. 1 is a front, perspective view of the device.
Figure 2:
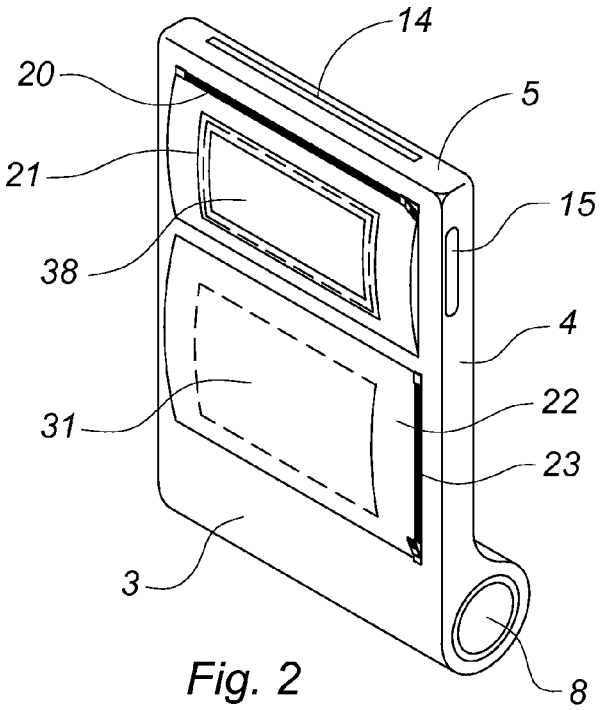
FIG. 2 is a rear, perspective view of the device.
Figure 3:
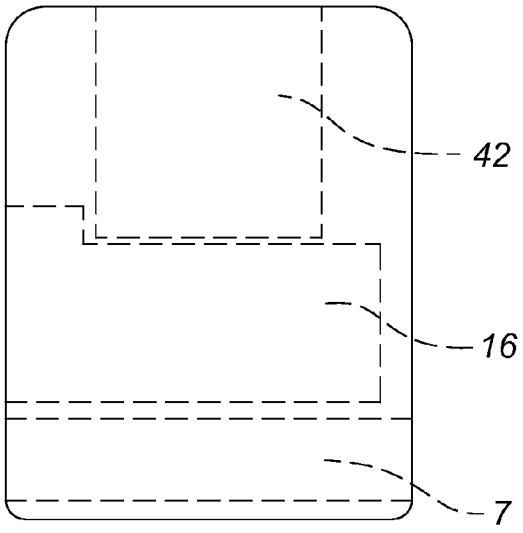
FIG. 3 is a front, sectional view of the device.
Figure 4:
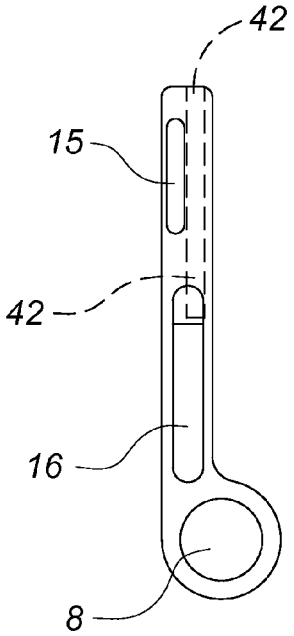
FIG. 4 is a side, sectional view of the device.

The present invention relates to a golfer's organizer for storing a plurality of golfing accessories. The device comprises a substantially-planar housing 1 having a front surface 2, a rear surface 3, a pair of side edges 4, a top end 5 and a bottom end 6. The planar configuration of the housing is aesthetically superior to conventional bulky or protruding belt-mounted retainers; furthermore, the housing is thin, compact and symmetrical so as not to interfere with a golfer's swing. The housing is preferably constructed with a semi-rigid, plastic inner frame that is encapsulated with a layer of fabric, leather or similar comfortable material.

On the lower end of the housing is a barrel-shaped golf ball holder 7 having an interior chamber that is dimensioned to tightly receive a standard-sized golf ball 63. The ball holder includes an opening 8 at each of two opposing sides thereof allowing either a left-handed or right-handed golfer to easily slide golf balls into and out of the interior chamber. The fabric layer 65 extends slightly into the interior chamber to retain stored balls whenever the housing moves. However, the plastic frame material flexes slightly, allowing a golfer to easily remove a ball by applying pressure thereto. On the exterior surface of the ball holder is a transparent retainer 66 for conspicuously displaying an advertising placard associated with a golf supplier, a golf resort or a similar business.

On the front surface of the housing, immediately above the golf ball holder, is a nylon cleaning strip 9 for removing debris from various golfing tools. Preferably, the strip is constructed with an abrasive knit fabric, such as that often used to construct a "scrunchie"-style ponytail holder. Immediately above the strip is a terrycloth 10, which can be used to apply moisture to heavily-stained items, such as golf balls. The plastic frame forms a water-impermeable barrier that allows a significant amount of fluid to be applied to the cloth without damaging any stored items. A plurality of horizontally-aligned sleeves 11 on the housing front surface each receive a golf tee 12. Furthermore, the terrycloth 10 is peripherally secured to the frame while an upper edge is free so that additional tees may be stored between the cloth and the housing.

On the front surface of the housing is a fastener 68 to which a timepiece 102 is removably secured. The timepiece includes a clock face 103 for indicating current time of day and a rear face with a strap 104 depending therefrom. The strap includes a fastener 67 at a distal end that mates with the fastener 68 on the housing to secure the timepiece thereto. When not in use, the timepiece will unobtrusively dangle from the housing; however, a wearer can determine the current time without removing or shifting the housing or fumbling through a storage pocket by simply turning the timepiece to a position where the clock face is readily visible. Furthermore, if the housing is being cleaned or if time is not an issue, the wearer can completely detach the timepiece. In the preferred embodiment, the timepiece fasteners are hook-and-loop though any type of fastener may be used. Accordingly, the golfer can easily monitor the duration of a given round without wearing or otherwise handling a watch.

A tubular pencil holder 13 and abacus-type stroke counter 27 is disposed immediately above the tee holders for assisting a golfer with monitoring strokes. Between the tee sleeves and terrycloth is a clip 75 to which a divot-repair tool 50 is secured. Preferably, a ball marker 110 is magnetically secured to the divot-repair tool to allow a golfer to easily mark a golf ball without clumsily searching a trouser or golf-bag pocket.

The upper end of the housing includes a wide-profile slit 14 in communication with an interior compartment 42 for slidably receiving a scorecard 70. The slit is dimensioned to tightly engage both sides of the scorecard to prevent inadvertent displacement.

A belt 71 passageway 15 extends from one side edge of the housing to the other for suspending the device from a golfer's belt. When the device is suspended from a belt, the rigid frame maintains the overall structural integrity as opposed to conventional belt clips or loops. On one of the housing side edges is a compartment 16 that removably receives a helical cord 17 having a drying cloth 19 and a club-face groove cleaning tool 18 secured thereto. The cleaning tool has a steel-wool brush 80 and a plastic-bristle brush 81 at one end, and a pointed scraper 82 at an opposing end to remove dried or tenacious debris.

On the rear surface of the housing is a zippered pouch 20 for storing keys, jewelry and similar valuables. The pouch may also include an identification pocket 21 with a transparent panel 38 for receiving an ID card to personalize the device, if desired. A utility compartment 22 is positioned immediately beneath the pouch and includes a zipper 23 for accessing the interior that can store paper currency, credit or business cards and similar items. A smaller, open receptacle 31 is superimposed on the utility compartment for temporarily holding a few business cards for quick access.

The above-described invention is not limited to the exact details of construction in the enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A golfer's organizer for storing a plurality of golfing accessories comprising:

a substantially-planar housing having a front surface, a rear surface, a pair of side edges, a top end and a bottom end, wherein said housing is constructed with a semi-rigid plastic inner frame that forms a moisture-impermeable barrier, said frame encapsulated with a layer of comfort-enhancing material;

a golf ball holder at the lower end of the housing for storing a plurality of golf balls, wherein said golf ball holder is barrel-shaped and includes an opening at each of two opposing sides thereof that are in communication with an interior chamber allowing a golfer to easily slide golf balls into and out of the holder from either of said sides, said layer of comfort-enhancing material extending slightly into the interior chamber to form a retainer for balls received within said chamber to prevent inadvertent displacement if said housing is moved, said plastic inner frame being slightly flexible to allow a golfer to easily remove a ball by applying pressure thereto;

and an abacus-type stroke counter positioned on the front surface of said housing for assisting a golfer with monitoring strokes.

2. The golfer's organizer according to claim 1 further comprising a transparent retainer on the exterior surface of said ball holder for conspicuously displaying an advertising placard associated with a desired business.

3. The golfer's organizer according to claim 1 further comprising a divot-repair tool detachably secured to the front surface of said housing, said tool having a ball marker magnetically secured thereto to allow a golfer to easily mark a golf ball without clumsily searching a trouser or golf-bag pocket.

4. The golfer's organizer according to claim 3 further comprising a timepiece removably attached to the front surface of said housing for monitoring time while playing a round of golf, said timepiece including a clock face for indicating current time of day and a rear face with a strap depending therefrom, said strap having a fastener at a distal end that mates with a fastener on said housing to secure the timepiece thereto whereby said timepiece, when not in use, unobtrusively dangles from the housing but is easily grasped and reoriented to determine the current time, and whereby said timepiece is completely detachable to clean said housing.

5. The golfer's organizer according to claim 4 further comprising a cleaning strip constructed with an abrasive knit fabric positioned on the front surface of said housing for removing debris from various golfing accessories.

6. The golfer's organizer according to claim 4 further comprising a plurality of horizontally-aligned sleeves on the front surface of said housing, each of said sleeves for receiving a golf tee.

7. The golfer's organizer according to claim 4 further comprising a tubular pencil holder positioned on the front surface of said housing.

8. The golfer's organizer according to claim 4 further comprising a narrow slit on the upper end of said housing, said slit in communication with an interior compartment for slidably receiving a scorecard.

9. The golfer's organizer according to claim 8 wherein said slit is dimensioned to tightly engage both sides of a scorecard to prevent inadvertent displacement.

10. The golfer's organizer according to claim 4 further comprising a compartment on one of the side edges of said housing that removably receives a helical cord, said cord having a drying cloth and a club-face groove-cleaning tool secured to a distal end thereof.

11. The organizer according to claim 10 wherein said cleaning tool has a steel-wool brush and a plastic-bristle brush at one end, and a pointed scraper at an opposing end to remove dried, tenacious debris.

12. The golfer's organizer according to claim 4 further comprising a terrycloth on the front surface of said housing for applying moisture to heavily-stained items.

13. The golfer's organizer according to claim 12 wherein said terrycloth includes a pair of secured side edges and a free upper edge allowing golf tees to be secured between said terrycloth and said housing.

14. The golfer's organizer according to claim 12 further comprising a belt passageway extending from one of said side edges of the housing to the other of said side edges for suspending said housing from a golfer's belt.

15. The golfer's organizer according to claim 4 further comprising a zippered pouch on the rear surface of the housing for storing valuables.

16. The golfer's organizer according to claim 15 wherein said pouch includes an identification pocket having a transparent panel, said pocket for receiving an identification card allowing a user to display personalized information.

17. The golfer's organizer according to claim 16 further comprising a utility compartment positioned adjacent to said pouch, said compartment including a zipper for accessing the interior.

18. The golfer's organizer according to claim 17 further comprising an open receptacle superimposed on said compartment for temporarily holding business cards.

* * * * *